US005197389A

United States Patent [19]

Glomski et al.

[11] Patent Number: 5,197,389

[45] Date of Patent: * Mar. 30, 1993

[54] TIE REPLACER

[75] Inventors: Krzysztof E. Glomski; G. Robert Newman, both of Fairmont, Minn.; Harry Madison, Germantown, Tenn.

[73] Assignee: Harsco Corporation, Wormleysburg, Pa.

[ * ] Notice: The portion of the term of this patent subsequent to Sep. 17, 2008 has been disclaimed.

[21] Appl. No.: 756,984

[22] Filed: Sep. 9, 1991

Related U.S. Application Data

[63] Continuation-in-part of Ser. No. 512,206, Apr. 20, 1990, Pat. No. 5,048,424.

[51] Int. Cl.[5] ..... E01B 29/10

[52] U.S. Cl. ..... 104/9; 104/2

[58] Field of Search ..... 104/9, 6, 2, 5

[56] References Cited

U.S. PATENT DOCUMENTS

| | | | |
|---|---|---|---|
| 1,089,306 | 3/1914 | Bell . | |
| 3,521,769 | 7/1970 | Caperton . | |
| 3,698,324 | 10/1972 | Peppin et al. . | |
| 3,780,664 | 12/1973 | Holley et al. . | |
| 3,877,384 | 4/1975 | Fearon et al. . | |
| 3,948,185 | 4/1976 | Settle et al. . | |
| 3,964,397 | 6/1976 | Dieringer et al. . | |
| 4,127,070 | 11/1978 | Dieringer et al. . | |
| 4,392,433 | 7/1983 | Nyland . | |
| 4,643,100 | 2/1987 | Valditerra . | |
| 4,794,861 | 1/1989 | Theurer et al. | 104/9 |
| 4,809,614 | 3/1989 | Theurer et al. . | |
| 4,862,806 | 9/1989 | Theurer et al. . | |
| 4,884,509 | 12/1989 | Theurer et al. | 104/9 |
| 4,951,573 | 8/1990 | Madison | 104/9 |
| 4,955,301 | 9/1990 | Theurer et al. | 104/9 |
| 4,955,302 | 9/1990 | Theurer et al. . | |
| 5,048,424 | 9/1991 | Madison et al. | 104/9 |

*Primary Examiner*—Mark T. Le

*Attorney, Agent, or Firm*—Kerkam, Stowell, Kondracki & Clarke

[57] ABSTRACT

A tie replacement vehicle uses a tie feed arm to turn ties upon the main frame of the vehicle upside down such that they may be gripped by a tie inserter having a boom mounted below the main frame of the vehicle. The tie inserter has a tie clamp which may be shifted in the lengthwise direction of the vehicle in order to shift old ties out of the way. A tie pickup is mounted at each end of the vehicle for moving ties from the main frame of the vehicle to the rails. A conveyor system on the vehicle allows ties to be moved under the operator cab and engine.

24 Claims, 18 Drawing Sheets

TIE REPLACER

CROSS-REFERENCE TO RELATED APPLICATION

This application is a continuation-in-part of U.S. Ser. No. 512,206 filed Apr. 20, 1990, now U.S. Pat. No. 5,048,424, in the names of Harry Madison and G. Robert Newman, two of the inventors herein. That application is hereby incorporated by reference.

BACKGROUND OF THE INVENTION

This invention relates to a machine for inserting ties on a railroad track and a method of using such a machine. More specifically, this invention relates to a machine which also removes old ties from a railroad track road bed.

In order to maintain railroad tracks in safe operating conditions, it is necessary to replace the ties periodically. The ties (made of wood, metal or concrete) underneath the rails tend to wear out after an extended period of use.

Various machines for removing and/or inserting railroad ties into the railroad track road bed (hereafter "road bed") have been developed.

Among the prior machines for replacing ties are the machines disclosed by the following patents:

| U.S. Pat. No. | Inventor | Issue Date |
|---|---|---|
| 3,780,664 | Holley et al. | December 25, 1973 |
| 3,964,397 | Dieringer et al. | June 22, 1976 |
| 4,392,433 | Nyland | July 12, 1983 |
| 4,809,614 | Theurer et al. | March 7, 1989 |

The Holley et al patent shows a machine for inserting ties beneath a railroad track having a pantograph system to control the orientation of a tie clamp which is used for manipulating the tie. As common with many types of machines for removing ties, the arrangement includes rail clamps to secure the machine to the rail and a jacking system for supporting the machine on the ground while using the rail clamps to lift the rails to more easily remove or insert the tie disposed below the rail.

The Dieringer et al patent shows a tie handling machine having an inserter with a tie clamp and a boom for insertion of new ties. The new ties are laid upon the rails in advance of the machine.

The Nyland patent shows a backhoe type tie remover/inserter. An articulated arm at one end of the machine is used to manipulate ties. The other end of the machine has a loader bucket as commonly used on regular backhoes. The machine has tractor wheels for running on the road and a second set of wheels for rolling along a railroad track. Vertical "outrigger" jacks may be moved horizontally and used to support the vehicle as best shown at FIG. 6. Rail clamps may be used in combination with the vertical jacks in order to raise the rail for making it easier to insert or remove a tie from a particular portion of the track.

The Theurer et al patent shows a tie gang apparatus and system wherein a number of individual tie exchanging devices are operated substantially simultaneously at different track sections. The speed of the process is enhanced by the tandem arrangement of tie withdrawing and inserting devices.

Although prior tie inserter and/or remover machines have been generally useful, they have been subject to one or more of a number of disadvantages.

Some prior tie inserter vehicles insert new ties which have been previously deposited on the rails in advance of the vehicle. This is generally advantageous in that it is usually easier and quicker to pick up a tie laying upon the pair of rails then to pick up a tie which is deposited to the side of the road bed. However, depositing the ties upon the rail generally prevents one from using a tandem arrangement whereby different tie insertion vehicles operate upon different sections or zones of the road bed. In other words, a vehicle or device moving in front of the tie inserter can deposit the ties upon the rails, but this will allow only a front tie inserter vehicle to make use of the ties. Any second or following tie inserter vehicle will be separated from the source of the ties and the ties themselves by the front tie inserter vehicle.

Although one could in theory have a tandem arrangement of tie inserter vehicles wherein ties are placed upon the rails by a first source of ties (usually a flat car or cars having bundles of ties together with a crane or other arrangement for unloading the ties) in front of the first tie replacing vehicle and a second source of ties in between the first and second tie replacing vehicles, this increases the number of the machines needed for the tie gang operation and increases the cost and complexity of the operation.

One way to avoid the difficulty in providing tandem operation of tie insertion vehicles whereby two or more tie insertion vehicles operate simultaneously in different sections or zones of the road bed, is to place the ties to the side of the rail. In that fashion, the first tie inserter vehicle may move along the rail to its section, while bypassing the ties disposed at the side of the road bed, which ties may then be used by a second or following tie inserter vehicle. However, it is usually more difficult, time-consuming, and complex to provide an arrangement whereby a tie inserter vehicle picks up ties from the side of a road bed.

Another disadvantage of vehicles and mechanisms which are commonly used for tie insertion and tie removal is that they often require a first complex series of operations to remove an old tie followed by a second series of complex operations to insert a new or replacement tie.

A further disadvantage of numerous prior tie inserters is that an operator must perform relatively complex operations in order to clamp the new tie.

A further disadvantage of numerous prior tie inserter devices and systems will be more readily understood after a brief discussion of the procedures used for tie replacement. The tie replacement is accomplished by a tie gang which includes numerous machines which move along the rail. It should be noted that it is common to selectively replace only some of the ties. For example, one might replace only every third or fourth tie in a particular region. A spike pulling device or vehicle is used to pull spikes from the tie plates corresponding to ties which are to be replaced. A spike collecting device or vehicle could be used to collect the pulled spikes. A ballast clearing device is commonly used to make it easier to remove old ties within the road bed. A machine or vehicle lifts the rails at a portion of the track while pulling out an old tie disposed under that portion. The tie plates corresponding to the tie which is being replaced are usually replaced because the tie plates drop free of the rails upon lifting of the rails. After new ties and tie plates have been inserted, a machine is used for tamping ballast and a vehicle or device is used for spiking the replacement tie plates into the replacement ties. Of course, a vehicle or machine must be used to supply the replacement ties to the vehicle or machine which is inserting the replacement ties. Various other machines could be used as part of the overall process.

The complexity of the above process is substantially increased by the common requirement for removing old tie plates, which fall when the rail is lifted, and inserting and properly placing new tie plates. The increased complexity, cost, and time is disadvantageous in that the old tie plates are usually in quite acceptable condition. Indeed, often replacement tie plates are simply recycled old tie plates.

The invention of the Madison and Newman application referenced above avoided or minimized several of the problems discussed above. However, that tie replacement technique requires about 12 feet of clearance to the side of a rail. This may work fine at most locations, but some places along a railroad track do not have sufficient clearance. Further, the requirement for moving ties over the top of an operator cab and, especially, the mounting of the tie inserter boom above the main frame on that design meant that one had to be careful to maintain the stability of the vehicle.

OBJECTS AND SUMMARY OF THE INVENTION

Accordingly, it is a primary object of the present invention to provide a new and improved tie inserter vehicle.

A more specific object of the present invention is to provide tie insertion whereby two or more tie inserter vehicles can work in tandem, while both (or all) tie inserter vehicles use ties which have been deposited upon the rail in advance of the leading tie inserter vehicle.

Yet another object of the present invention is to provide selective tie replacement (i.e., removal of old tie and insertion of replacement tie) by a mechanism which minimizes the time required by beginning to position the replacement tie, while simultaneously removing the old tie by a single cycle (or extension) of a boom.

A still further object of the present invention is to provide for more efficient tie replacement by avoiding the need to replace tie plates which are in acceptable condition.

Yet another object of the present invention is to provide for the insertion of ties wherein a replacement tie may be easily and quickly clamped by a tie inserter mechanism without requiring difficult (e.g., requiring great dexterity or hand - eye coordination) steps by a human operator.

A still further object of the present invention is to avoid or minimize the disadvantages noted above with respect to the prior tie inserter arrangements.

Another object of the present invention is to facilitate tie replacement at locations where obstructions minimize the space.

Yet another object of the present invention is to provide a tie replacer which is very stable in operation.

The above and other objects of the present invention which will become more apparent as the description proceeds are realized by a tie replacement vehicle including a main frame having a pair of front wheels and a pair of rear wheels. A lifting means has a portion disposable at rail level corresponding to a pair of rails upon which the wheels are supported. The lifting means is mounted at a first end of the main frame and operable to lift ties from a pair of rails to the main frame. A lowering means has a portion disposable at rail level and is mounted at a second end of the vehicle opposite the first end. The lowering means is operable to lower ties from the main frame to placement on top of the pair of rails. A movement means selectively moves ties over the main frame from the lifting means to the lowering means. A tie inserter is supported by the main frame and includes a tie clamp operable to clamp ties. The tie inserter is operable to receive a tie previously placed above the main frame by the lifting means and is operable to insert a new tie under the pair of rails while the new tie is clamped by the first tie clamp. The tie inserter is further operable to remove old ties from the road bed. The tie inserter includes a boom extendable in a boom direction transversed to a lengthwise direction of the vehicle and a tie inserter head having the tie clamp mounted thereon. The tie inserter head is rotatable about a substantially horizontal axis relative to said boom. The tie inserter is operable to insert ties in the road bed by retraction of the boom. The substantially horizontal axis extends parallel to the lengthwise direction of the vehicle.

An important feature of the present invention is the use of a tie feeding arm mounted to the main frame and having a feed gripper. The tie inserter receives a tie from above the main frame by way of this tie feeding arm. The tie feeding arm is limited to moving a tie perpendicular to a lengthwise direction of the vehicle and within a vertical new tie movement plane. The tie feed arm includes a first member mounted to the main frame, a second member pivotably mounted to the first member and having the feed gripper mounted thereon, and a swing means to pivot the second member relative to the first member. The second member extends at least partly in a lengthwise direction of the vehicle. The tie clamp is operable to clamp ties disposed parallel to and offset from the boom direction. The tie clamp is operable to clamp ties when disposed in the vertical new tie movement plane. The tie feeding arm turns a tie upside down and end for end as it moves the tie from above the main frame to the tie inserter. The boom is disposed below the main frame and is pivotable about a horizontal axis extending perpendicular to the boom direction. The tie clamp is movable relative to the boom to shift a tie transverse to the boom direction.

The present invention may alternately be described as a main frame having a pair of front wheels and a pair of rear wheels and a tie holding station on the vehicle for holding new ties for insertion. A tie feed arm is mounted to the main frame and has a feed gripper for gripping a new tie at the tie holding station. The tie feed arm is operable to pivot about a horizontal axis extending in a lengthwise direction of the vehicle to lower a tie from the main frame. A tie inserter is mounted to the main frame and includes a tie clamp operable to clamp ties supplied to the tie inserter by the tie feeding arm. The tie inserter is operable to insert a tie under the pair of rails while the tie is clamped by the tie clamp. A tie pickup is mounted at an end of the main frame and has a pickup clamp. The tie pickup is operable to move ties from resting on the rails to above the main frame. A movement means selectively moves ties over the main frame. An operator cab is mounted to the main frame by way of supports and the movement means moves ties horizontally below the operator cab and above the main frame. The tie pickup is operable to move ties by moving the pickup clamp along a vertical member.

BRIEF DESCRIPTION OF THE DRAWINGS

The above and other features of the present invention will be more readily understood when the following detailed description is considered in conjunction with the accompanying drawings wherein like characters represent like parts throughout the several views and in which.

DETAILED DESCRIPTION

Figure 1:
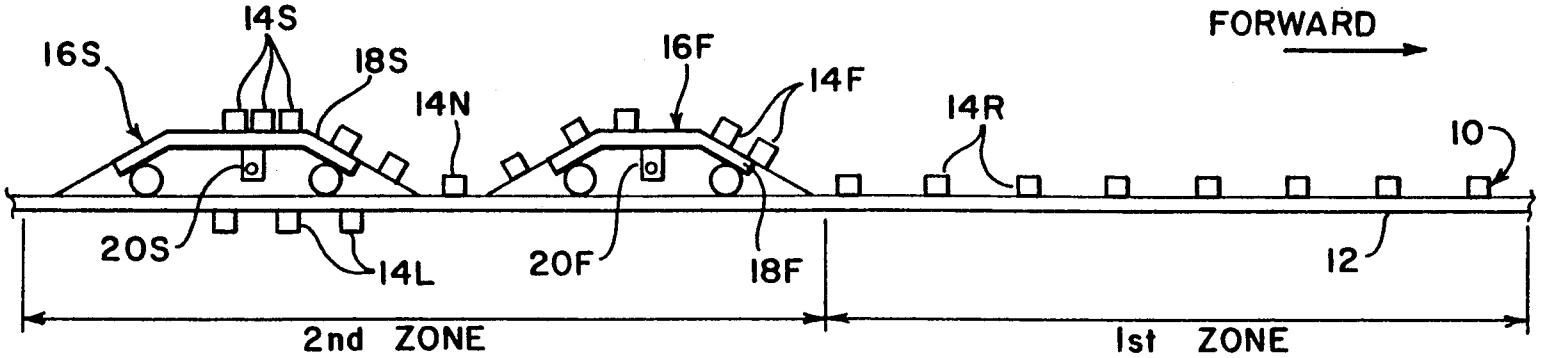
FIG. 1 is a schematic side view illustrating an important concept of the operation of the present invention.

With reference now to FIG. 1, the basics of the structure and operation of the tie inserter vehicle of the present invention will be explained. FIG. 1 shows a railroad track road bed 10 having a pair of rails 12 (only one of which is visible from the side view of FIG. 1) with a series of old ties 14L upon which the rails 12 are disposed. For ease of illustration, only a few of the old ties 14L are shown, but they are disposed all along the rails 12 and have ballast (not shown) in between them.

FIG. 1 also shows first and second tie inserter vehicles 16F and 16S which are used to replace selective ones of the old ties 14L with replacement or new ties 14R which have been placed upon the rails 12 in advance of the vehicle 16F and 16S. The vehicles 16F and 16S are illustrated in simplified fashion as versions of the tie inserter disclosed in detail in parent and incorporated by reference application Ser. No. 512,206, these versions being embodiments of the present invention as broadly defined. However, the present application discloses an improved tie inserter vehicle and the present description will concentrate on that improved vehicle. Since the improved vehicle allows for tandem operation as with the vehicle of the parent application, the explanation of tandem operation relative to FIG. 1 applies to the new design as well. As indicated by the arrow and the word forward, the vehicles shown in FIG. 1 will be moving from left to right.

A significant feature of the present invention is that one may use the first vehicle 16F to selectively replace old ties within the first zone, while using the second vehicle 16S to selectively replace old ties 14L in the second zone of the road bed. Significantly, the second vehicle 16S may use ties which have passed over a conveyor system 18F from in front of the vehicle 16F to behind the vehicle 16F. Several ties such as 14F are shown passing over top of the vehicle 16F. The ties will pass completely over the vehicle 16F as it travels through the second zone. The ties which have passed over the vehicle 16F are deposited back upon the rail such as tie 14N. These ties will in turn be picked up by a conveyor system 18S mounted to the vehicle 16S. The ties travel up to the top of the vehicle 16S and may be held in place by an arrangement discussed in detail below. The ties back up as a group and are shown as 14S on top of the vehicle 16S. The ties 14S are then used by a tie inserter 20S (depicted schematically). In particular, the second vehicle 16S will remove selective ties 14L from the second zone and will replace those ties with ties 14S from the top of the vehicle 16S.

By having the conveyor system 18F mounted on top of the first vehicle 16F, the second vehicle 16S may use ties from the top of the rails 12, even though the first vehicle 16F must pass by the new or replacement ties before the second vehicle 16S reaches those ties. When the first vehicle 16F reaches the beginning of the first zone, a change may be made in the conveyor system 18F such that the ties will back up on top of vehicle 16F in similar fashion to the ties 14S disposed on second vehicle 16S. A tie inserter 20F of the vehicle 16F may then use those ties for replacing ties under the rails 12 within the first zone.

From the above, it will be appreciated that the vehicle allows for tandem operation whereby each of two tie replacement vehicles work in separate zones using ties previously disposed upon the top of the rails. The ties may be laid on top of the rails 12 using known techniques such as flat cars filled with ties (not shown) and a gantry crane (not shown) for moving the ties. The gantry crane or another machine may be used to place the ties upon the rails in front of both of the machines or vehicles 16F and 16S. There is no need to unload ties in between the vehicles 16F and 16S because of the manner in which the conveyor system 18F allows ties to pass over the vehicle 16F.

In the discussion above it was assumed that there would be two of the vehicles 16F and 16S. However, it will be readily appreciated that there could be three or a larger number of such vehicles in which case each of the vehicles would allow the ties to be conveyed over top of the tie replacement vehicles. For example, if one was using three such machines, there would be three zones and the first and second machine would pass through the third zone while leaving the ties behind for the third (back-most or trailing) machine to use. The first or lead tie replacement vehicle would pass through the second zone while conveying the ties over top of it such that the ties would be left behind for the second vehicle. The first vehicle would continue to the first zone whereupon it would begin storing the ties for use in replacing ties in the first zone. The second and third vehicles would respectively replace ties in the second and third zones. In that fashion, one can place the ties on top of the rail such that they may be more easily picked up for use by the vehicles, while at the same time providing for tandem operation of two or more tie replacement vehicles.

Figure 2:
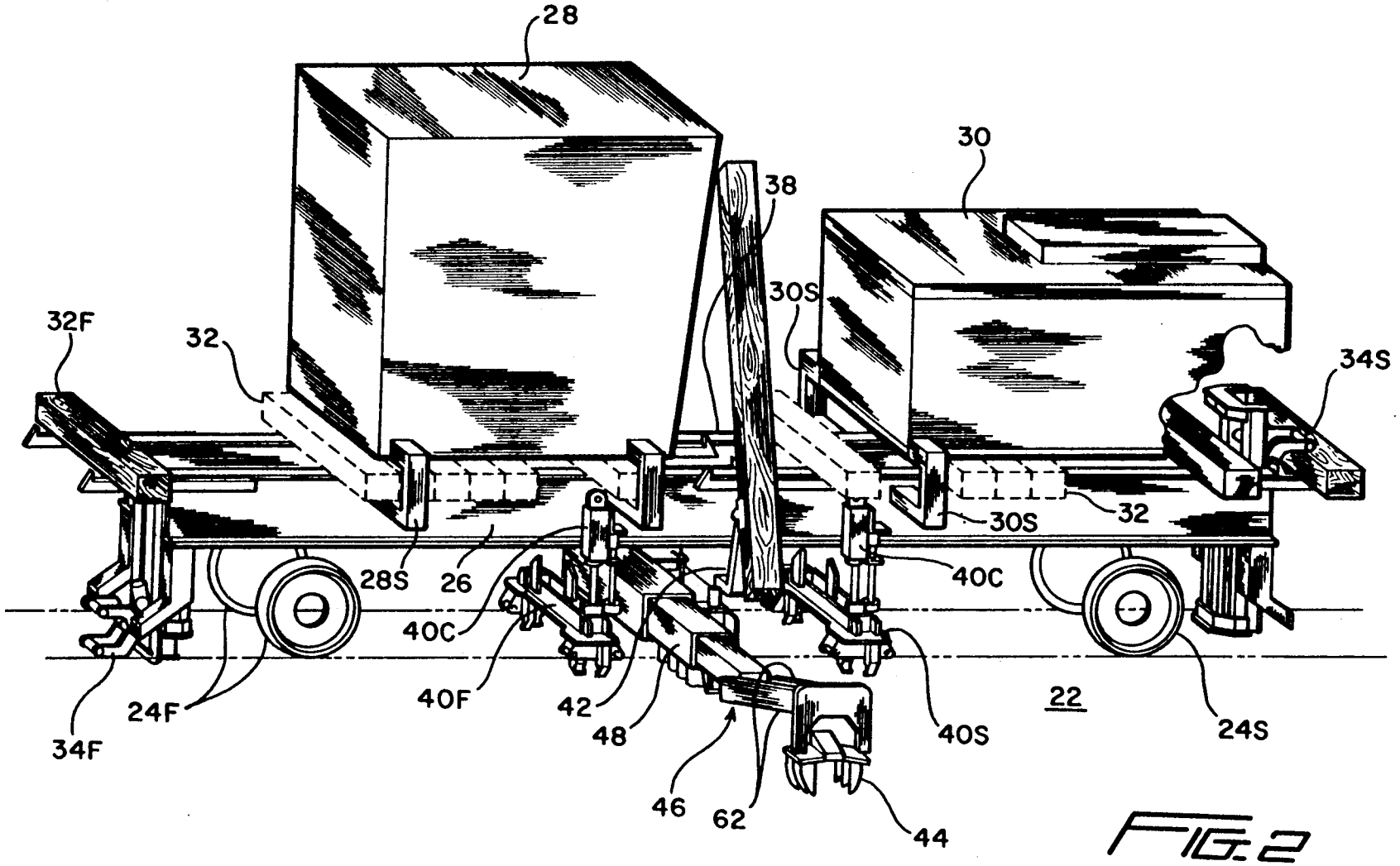
FIG. 2 shows an overall perspective view of the tie inserter vehicle of the tie replacer vehicle of the present invention.

Turning now to FIG. 2, the tie replacer vehicle 22 of the present invention will be discussed. Initially, it should be noted that the tie replacer vehicle 22 provides for the same type of tandem operation as discussed with respect to the tie inserter vehicles 16F and 16S of FIG. 1. However, there are several differences in the improved tie inserter or replacer vehicle 22 of FIG. 2. Among those differences is that vehicle 22 uses a different arrangement for picking up ties than the arrangement used by the vehicles such as 26F. Additionally, the ties are inserted in the roadbed by different mechanisms than those used with the vehicle 16F. Other differences will become apparent as this description proceeds.

The vehicle 22 includes front and back wheels 24F and 24S respectively mounted at front and back ends of a main frame structure 26. For ease of illustration, the details of the mounting of the wheels to the main frame 26 are not shown, but they may be of various standard arrangements. An operator cab 28 and an engine compartment 30 are mounted to the main frame 26 by way of supports 28S and 30S respectively. Although the perspective view of FIG. 2 does not show and label all of the supports, there would be one of the supports 28S or 30S at each of the four corners at the bottom of the structures 28 and 30. As shown, the supports 28S and 30S allow movement of ties 32 above the main frame 26 and below the cab structure 28 and below the engine compartment 30. In addition to housing a diesel engine (not separately shown), the compartment 30 may also include a hydraulic pump (not shown) which may provide hydraulic power to various mechanisms of the present invention. Since the engine and pump are relatively standard on various rail maintenance vehicles, these features need not be described in detail.

A tie pickup mechanism 34F is disposed at the front of vehicle 22 and is used to pickup ties such as 32F for placement above the main frame 26. Mounted to the main frame 26 are a series of conveyors such as 36F (schematically illustrated), which may be used to move the ties along the top of the main frame 26 to a tie holding station or zone 38, whereat the tie may be inserted by a process which will be described below. However, if the vehicle 22 is passing through the zone over which another vehicle will be inserting ties, the conveyor system on the main frame 26 may pass the tie to a tie pickup 34S, which tie pickup may be constructed like tie pickup 34F and used to lower the tie back down to the rails. Thus, the vehicle 22 may move along a rail and move ties from in front of it to behind it. The vehicle 22 could also move ties from the back of the vehicle to the front of the vehicle as the tie pickups 34F and 34S and the conveyor system including conveyors such as 36C may be constructed to allow movement in both directions.

Further, the right and left sides of the vehicle 22 are generally symmetrical such that ties may be inserted or removed from either side using the mechanisms which will now be described.

Mounted to the main frame 26 are first and second rail clamps 40F and 40S. The rail clamps may be used in known fashion to clamp the vehicle 22 to the rails very securely in order to allow the vehicle 22 to remove an old tie and insert a new tie.

A tie feeding arm 42 moves ties down from the tie holding station or zone 38 so that they may be grabbed by the tie clamp 44 of a tie inserter 46 having a boom 48 and mounted to the underside of the main frame 26. The tie inserter 46 is used to remove old ties and to insert new ties which are provided to it from above the main frame 26 by way of the tie feed arm 42.

Figure 3B:
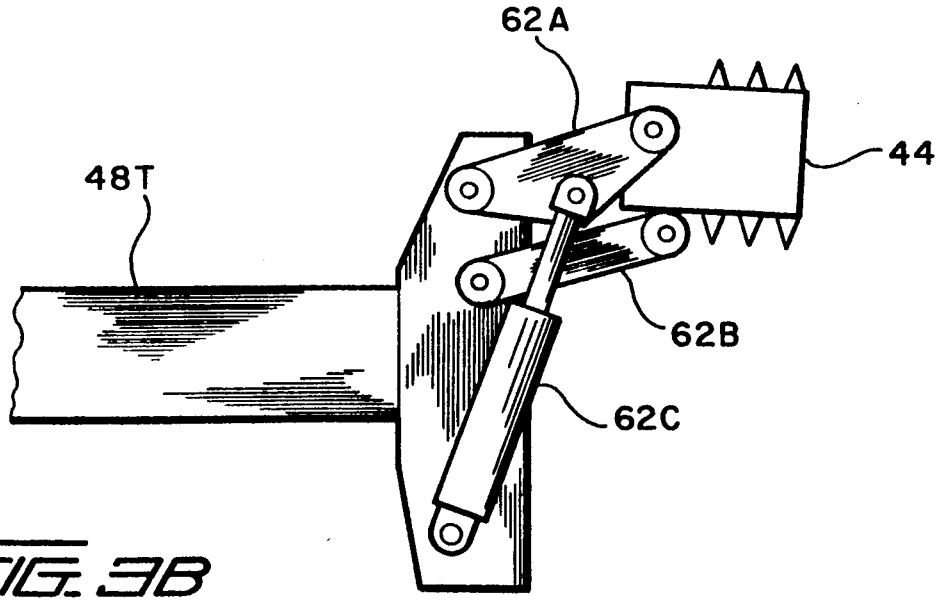
FIG. 3B is a simplified bottom view of parts of the mounting structure of a tie clamp.

Turning now to the perspective view of FIG. 3A, bottom view of FIG. 3B, front view of FIG. 4, top view of FIG. 5, and front view of FIG. 6, the details of the tie feed arm 42 and the tie inserter 46 will be discussed. It is also noted that the frame 26 includes two beams 26F and 26S extending in a lengthwise (i.e., front to back) direction relative to the vehicle.

Figure 3A:
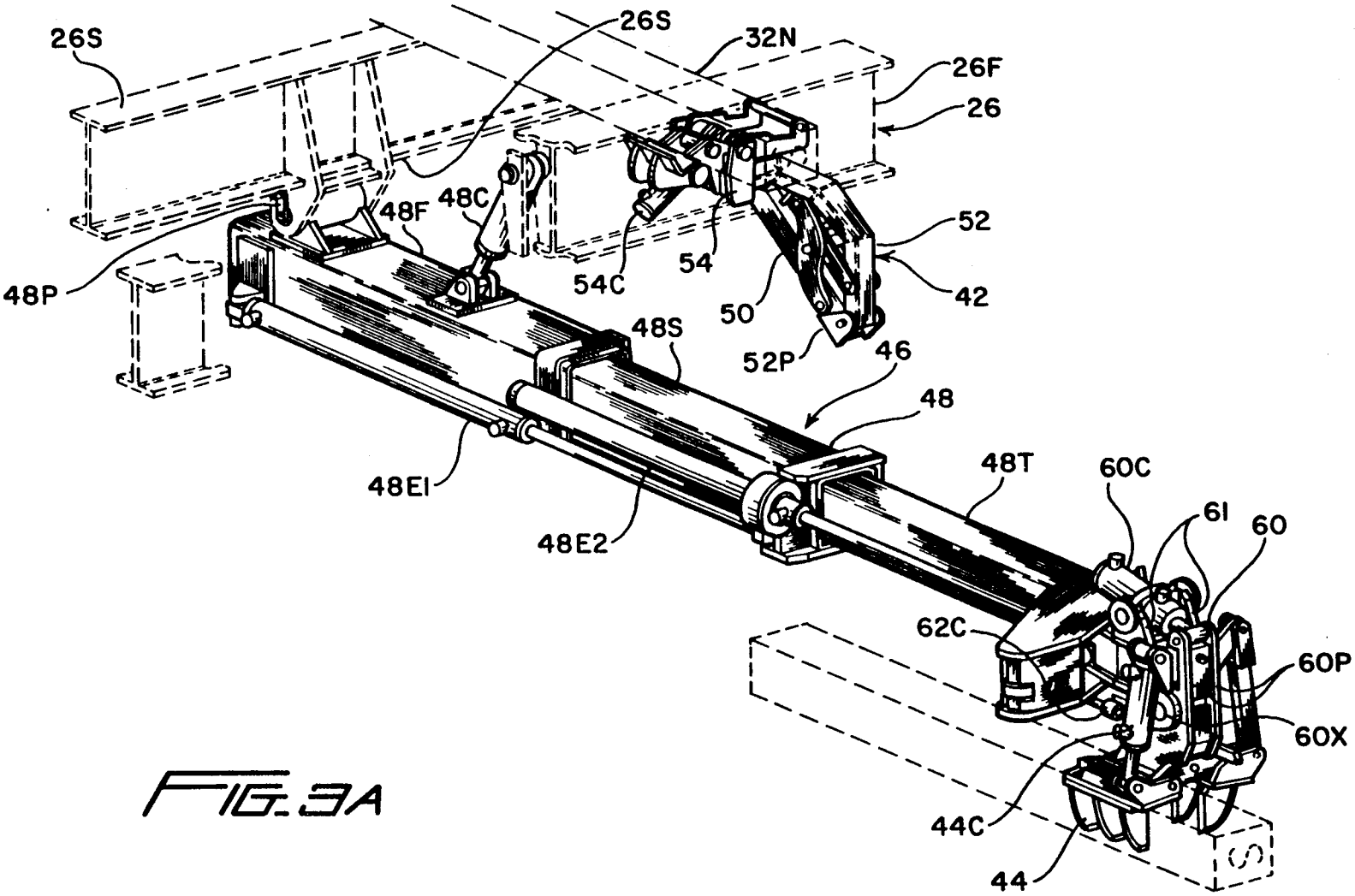
FIG. 3A shows a perspective view of a tie inserter and a tie feed arm according to the present invention.
Figure 4:
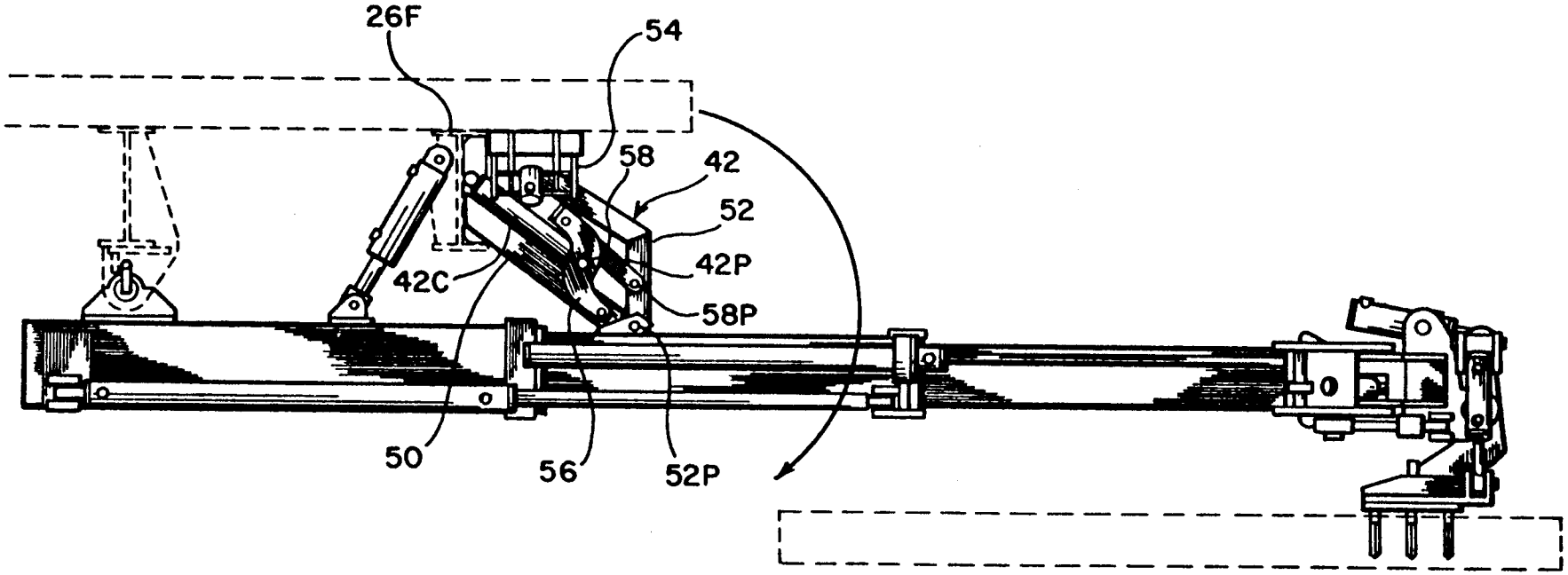
FIG. 4 shows a front view of the tie inserter and tie feed arm with a boom fully extended.
Figure 5:
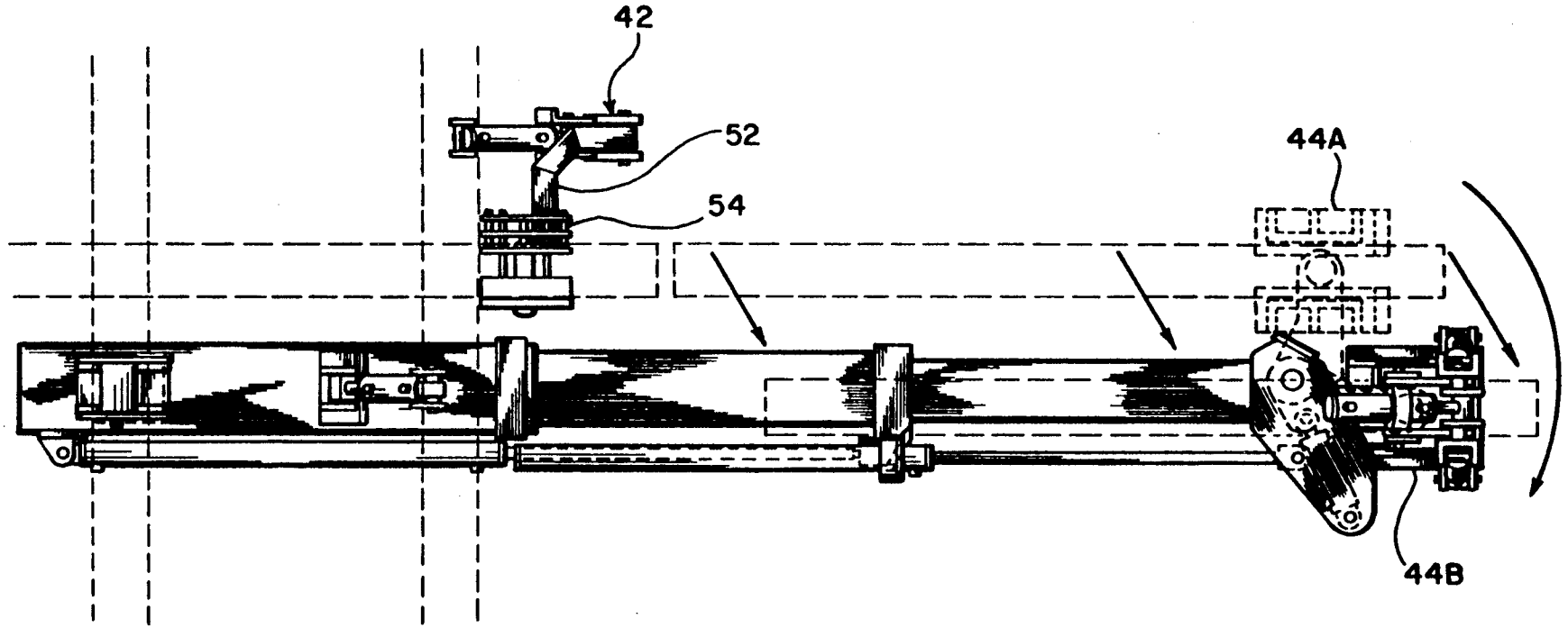
FIG. 5 shows a top view corresponding to FIG. 4.
Figure 6:
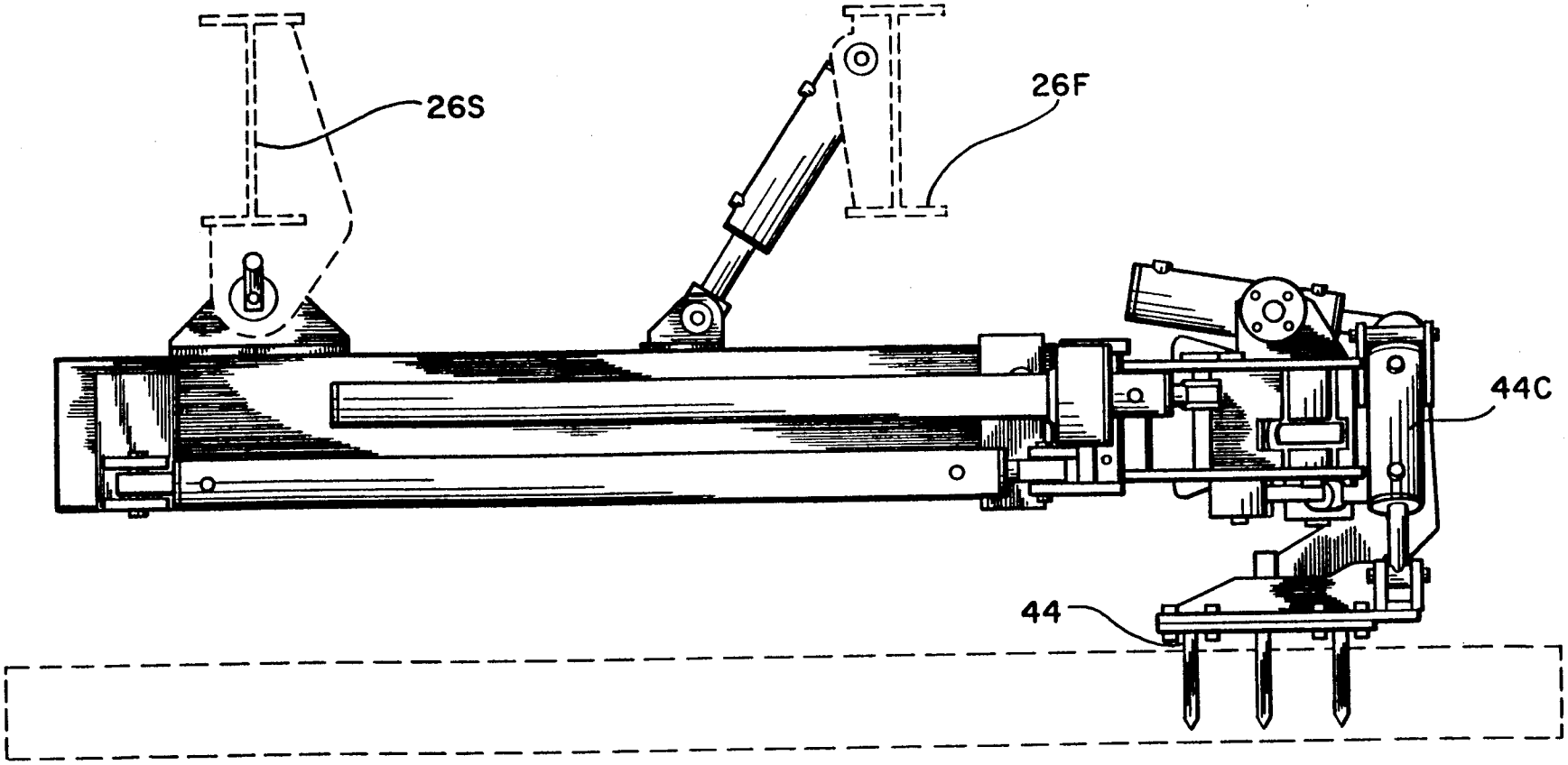
FIG. 6 shows a front view of the tie inserter with the boom retracted.

The feed arm 42, shown in FIGS. 3A, 4, and 5, but not FIG. 6, includes a first member 50 fixed to beam 26F and a second member 52 pivotably mounted to the first member at pivot point 52P. An opposite end of second member 52 has a tie feed gripper or clamp 54, which may be open and closed by use of a tie feed clamp hydraulic cylinder 54C. Referring especially to FIG. 3A, activation of the cylinder 54C allows the tie feed arm 42 to use its gripper or clamp 54 to clamp a new tie 32N above the main frame 26. The new tie 32N would then be turned upside down as the second member 52 pivots at pivot point 52P relative to the first member 50. More specifically, and with reference especially to FIG. 4, a tie feed arm cylinder 42C is used to pivot member 52 relative to member 50. The cylinder 42C is pivotably attached to beam 26F at an upper end and is pivotably attached at point 42P to a link 56, which link is also pivotably attached at opposite ends to the first member 50 and the second or swinging member 52. A further link 58 extends between the pivotal connection where link 56 attaches to member 52 and a lower pivotable connection 58P. Although only one link 56 and one link 58 are shown, it is to be understood that the tie feed arm 42 is symmetric in the sense that similar links would be on the side of tie feed arm 42 which is not visible in FIG. 4.

The structure of the tie inserter 46 will now be discussed especially with reference to FIG. 3A. The boom 48 has first, second, and third telescoping sections 48F, 48S, and 48T respectively. Boom section 48F is pivotably mounted at 48P to flanges on beam 26S such that the boom 48 may pivot about a horizontal axis running through point 48P, which axis extends in the lengthwise direction of the vehicle corresponding to the lengthwise direction of beams 26S and 26F. A boom raise/lower cylinder 48C is pivotably mounted to the section 48F and the beam 26F for controlling the raising and lowering of the boom. Boom extend/retract cylinders 48E1 and 48E2 are mounted as shown for extending and retracting the boom.

Tie clamp 44 is mounted at one end of boom section 48T by way of several intervening parts which allow positioning of the tie clamp 44 such that the tie clamp cylinder 44C may cause the tie clamp 44 to grip a tie or to release its grip on a tie. The tie clamp 44 is on a tilt assembly 60 having parallel plates 60P which rotate about a horizontal axis extending through pivot point 60X, the horizontal axis being perpendicular to the lengthwise direction of the boom. Hydraulic tie tilt cylinder 60C causes the rotation of plates 60P relative to plates 61 (FIG. 3A) about the axis extending through 60X such that the tie clamp 44 and any tie held by it may be tilted.

In addition to providing for movement of the tie clamp 44 by tilting it, the tie clamp 44 may be moved from a position 44A in FIG. 5 to a position 44B of FIG. 5. In the position 44A, the tie clamp may clamp an old tie as it is being removed and may clamp a new tie ready for insertion. Upon movement of the tie clamp 44 to the position shown at 44B of FIG. 5, the tie clamp will have transferred any old tie to a position just below the boom 48 such that the old tie may be dropped and it will not interfere with insertion of a new tie when the tie clamp is in the position 44A. The movement of the tie clamp 44 from position 44A to position 44B in FIG. 5 is accomplished by use of two members 62A and 62B best shown in simplified schematic FIG. 3B. The members 62A and 62B with pivotable connections at each end serve as part of a so - called four bar linkage such that tie clamp 44 (and thus any tie held by it) maintains its orientation as cylinder 62C moves it from being offset from the boom as shown in FIG. 3B to being in line with the boom as shown at 44B in FIG. 5. Although not shown in FIG. 3B for ease of illustration, the plates 61 (FIG. 3A) would be secured to the ends of members 62A and 62B opposite boom section 48T.

Turning now to FIGS. 7-11, the sequence of operations during the extraction and insertion process will be discussed. Initially, it should be noted that the vehicle 22 would be moved to where the feed gripper of the tie feed arm 54 is directly above the tie which is to be replaced. The feed arm 54 will be in a plane which may be called the new tie movement plane. Referring back momentarily to FIG. 5, the feed arm 54 will be in line when viewed from above with the tie clamp 44 now in its position 44A. In other words, both the tie clamp 44 and the feed gripper 54 are in the new tie movement plane, which plane is vertical and perpendicular to the lengthwise direction of the vehicle.

The brakes (not shown) would be set on the vehicle 22. The rail clamps such as 40F and 40S (refer back momentarily to FIG. 2) would clamp the rail. Plate holding magnets which will be discussed below engage the tie plates on the old tie which is to be removed. The rails are lifted up by cylinders 40C (FIG. 2) and the tie plates are lifted up by cylinders 94C discussed below with respect to FIG. 18.

Figure 7:
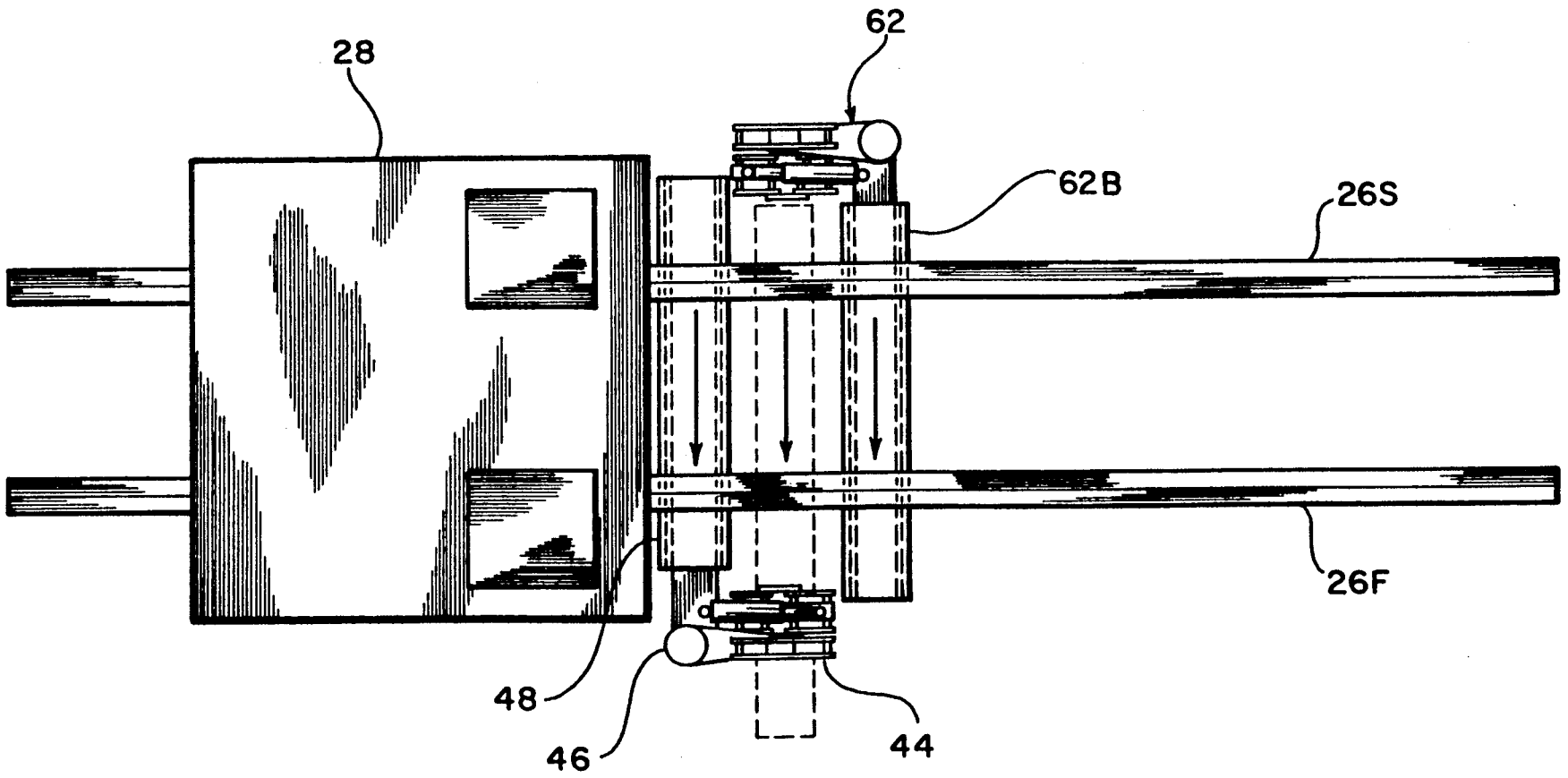
FIGS. 7, 8, and 9 are top views showing the sequence of operations for removing an old tie from under a rail.
Figure 8:
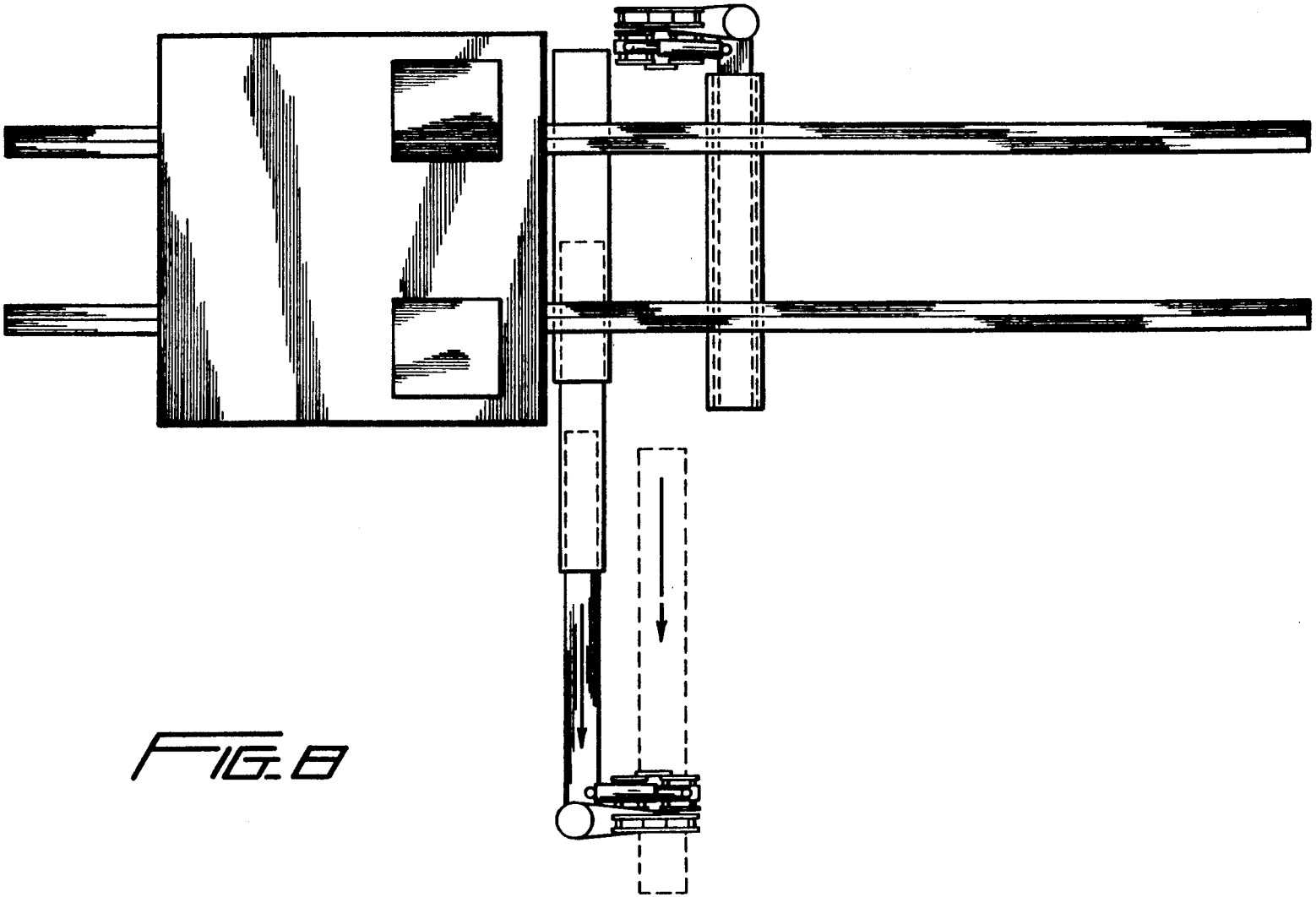
Figure 9:
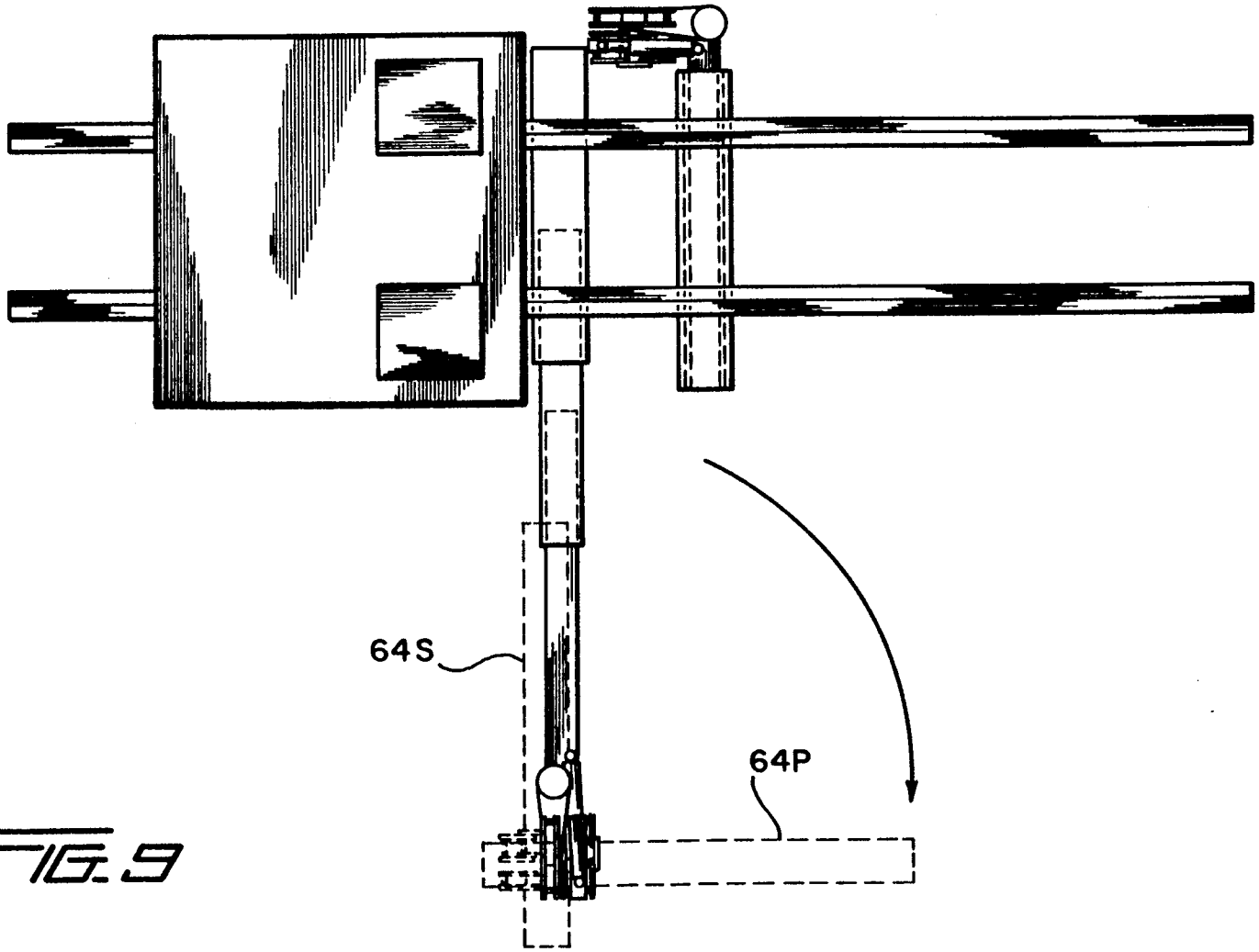

In the position of FIG. 7, the tie inserter 62, which is constructed in the same way as tie inserter 46 has been lowered by way of cylinder 48C and retracted such that it pushes the illustrated old tie in the position shown. This pushing, commonly called kicking, moves the old tie approximately 15 inches, whereupon the tie inserter 62 and its boom 62B may be raised. The tie inserter 46 may then use its tie clamp 44 to grip the tie, whereupon the boom 48 of tie inserter 46 is extended to move the old tie about 96 inches. The boom cylinder 48C (refer back momentarily to FIG. 3A) raises the boom up to clear the tie bed ridge. The old tie will now be in the position shown in FIG. 8. At that stage, the four bar linkage arrangement shifts the tie about 18" while maintaining it parallel to the boom direction and then releases the old tie, this shifting of the old tie being shown in FIG. 9. (An optional modification would allow the tie to be swung 90° in a substantially horizontal plane and released in a position parallel to the center line of the track.) The side shifted release position of the old tie is shown as 64S in FIG. 9, whereas the optional swinging position is shown as 64P. After release of the old tie, it will now be clear and not interfere with lowering and insertion of a new tie.

Figure 10:
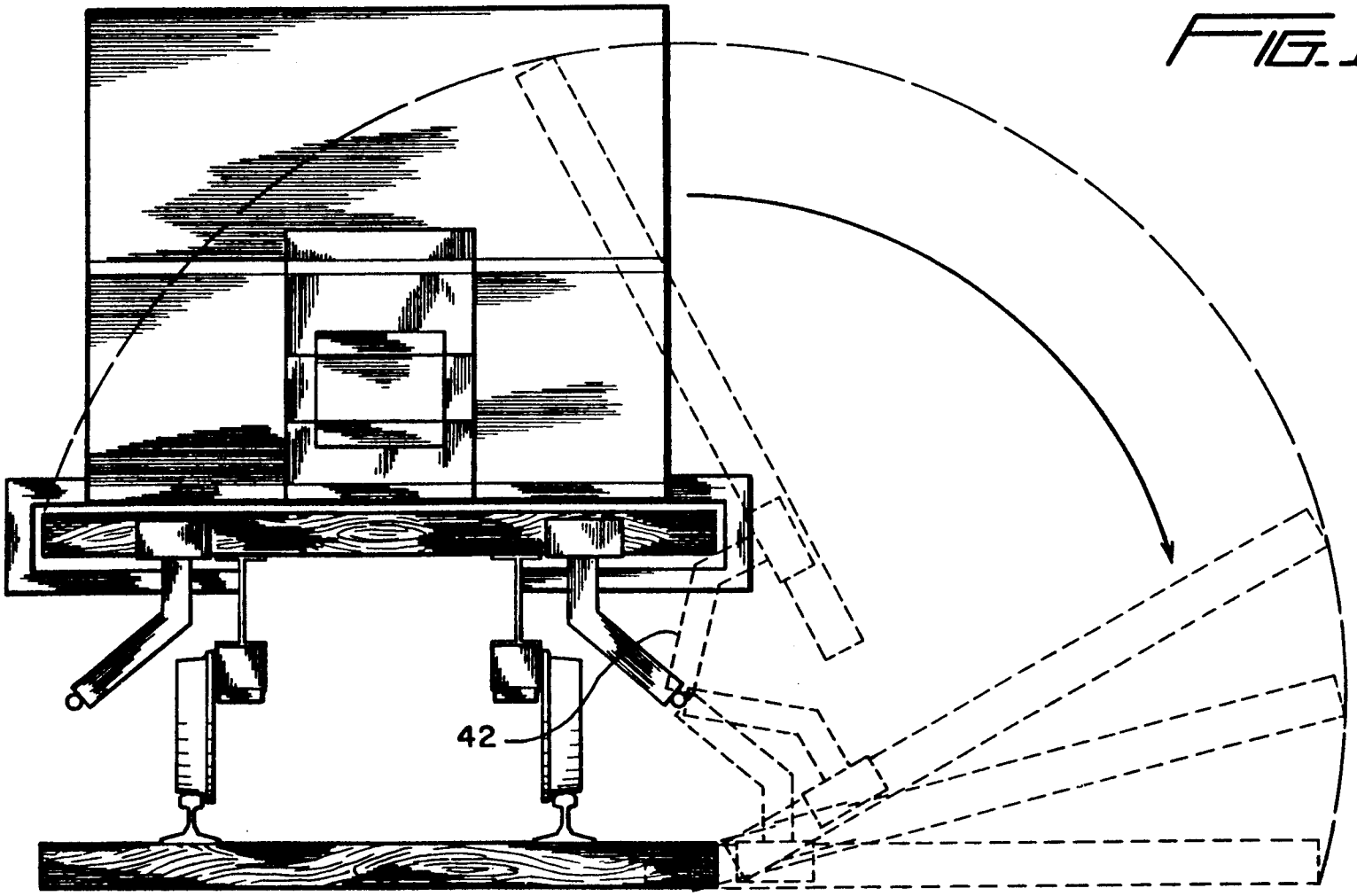
FIG. 10 is a front view showing how the tie feed arm feeds a new tie into position where the tie inserter may grip it.

With reference now to FIG. 10, the tie feed arm 42 turns a new tie upside down and end for end while moving it in the new tie movement plane. When the new tie is in the horizontal position of FIG. 10 or even a slightly inclined position, the tie clamp 44 (not shown in FIG. 10) will clamp the new tie, whereupon the tie feed arm 42 will rotate back up and clamp the next new tie and place it in a holding position.

Figure 11:
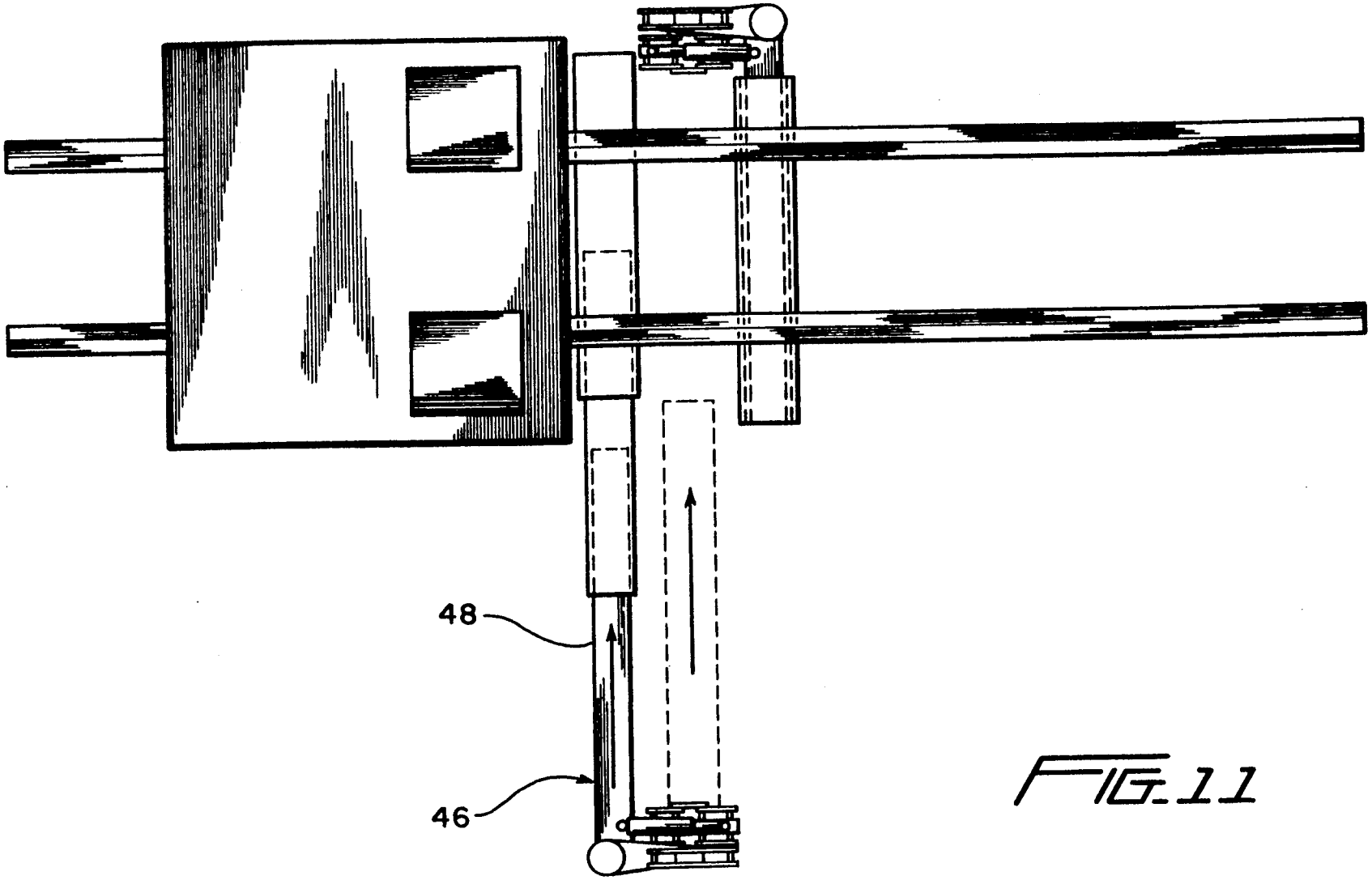
FIG. 11 is a top view showing a new tie being inserted by the tie inserter.

Referring next to FIG. 11, the tie inserter 46 then inserts the new tie by retracting the boom 48.

Advantageously, the tie feed arm 42 allows the boom 48 of tie inserter 46 to be mounted below the main frame 26 for improved stability. Moreover, the motion of the tie feed arm 42 in turning ties upside down and passing the ties to tie inserter 46 allows one to operate with less clearance than the design of the parent application.

Figure 12:
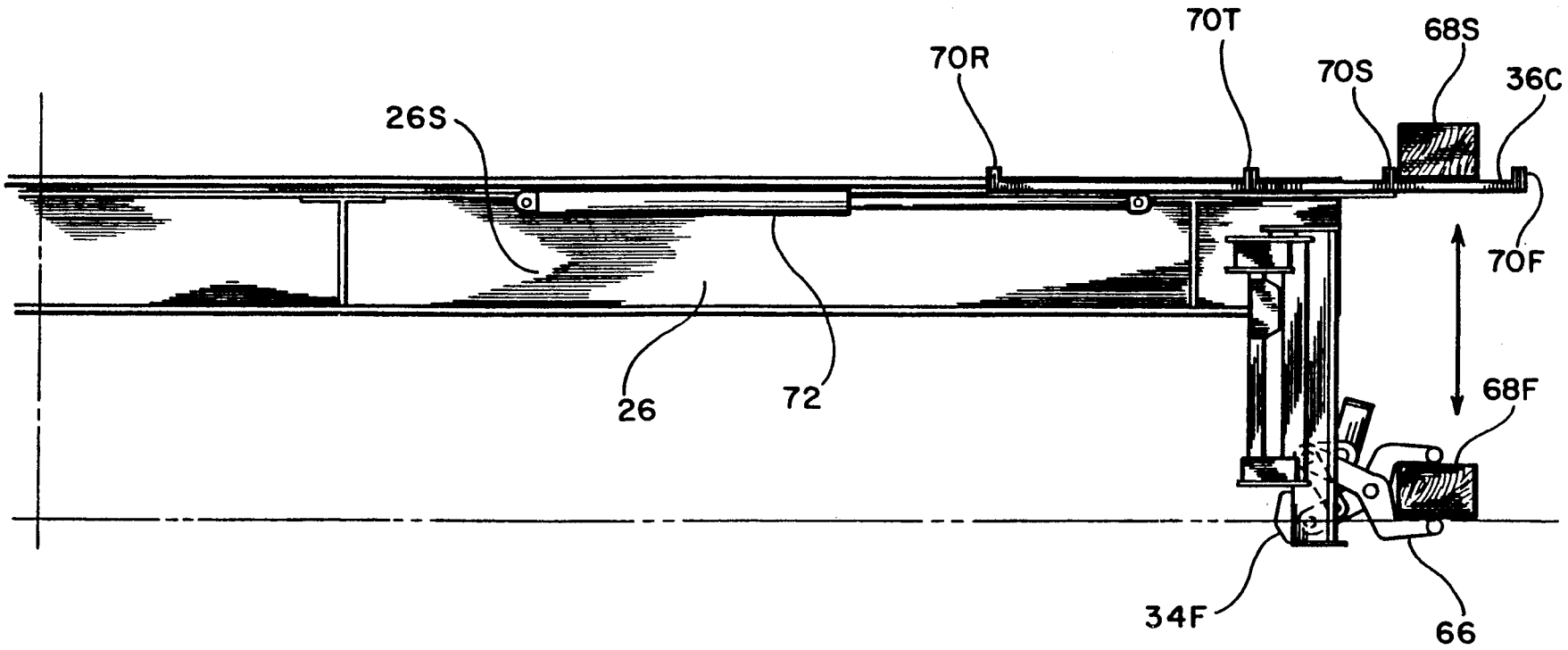
FIGS. 12 and 13 show side views of a tie pickup and a conveyor illustrating how ties are picked up by the present invention.
Figure 13:
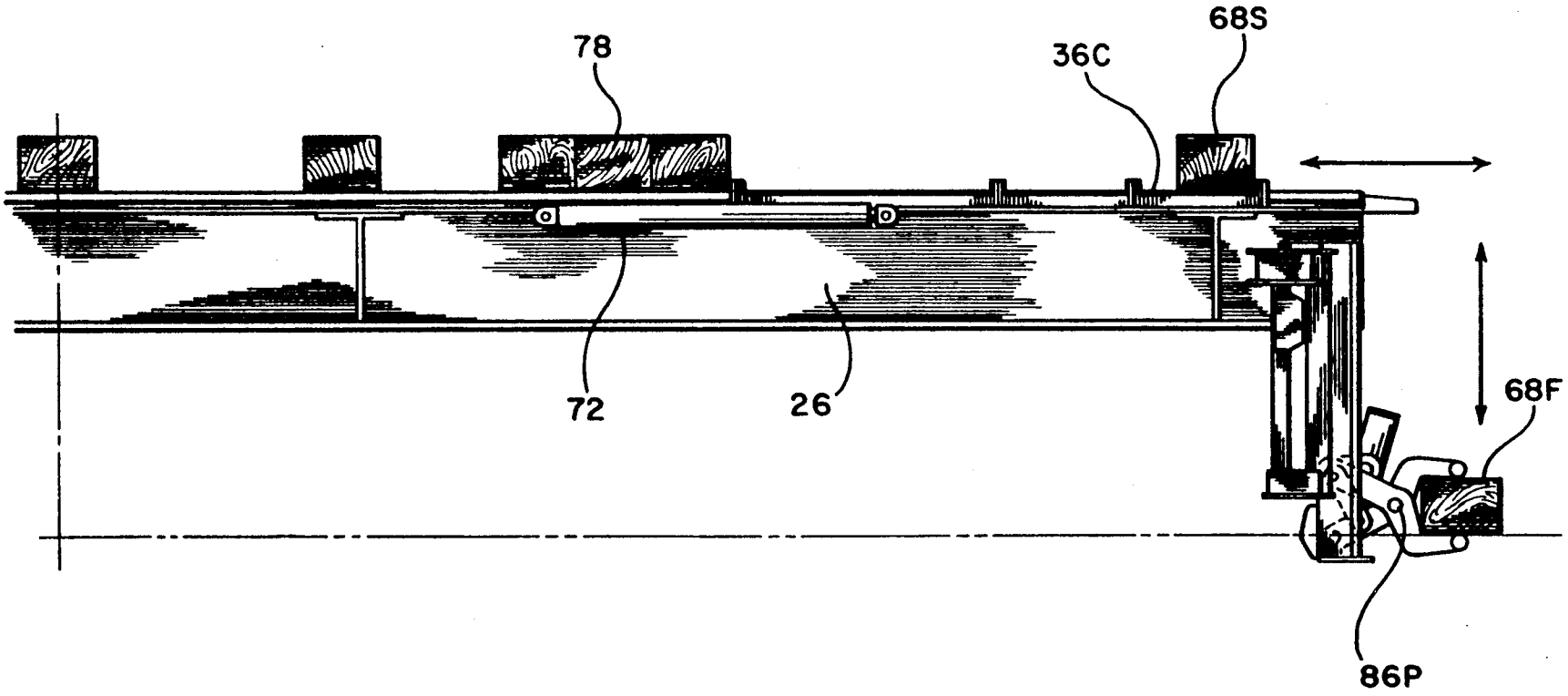
Figure 14:
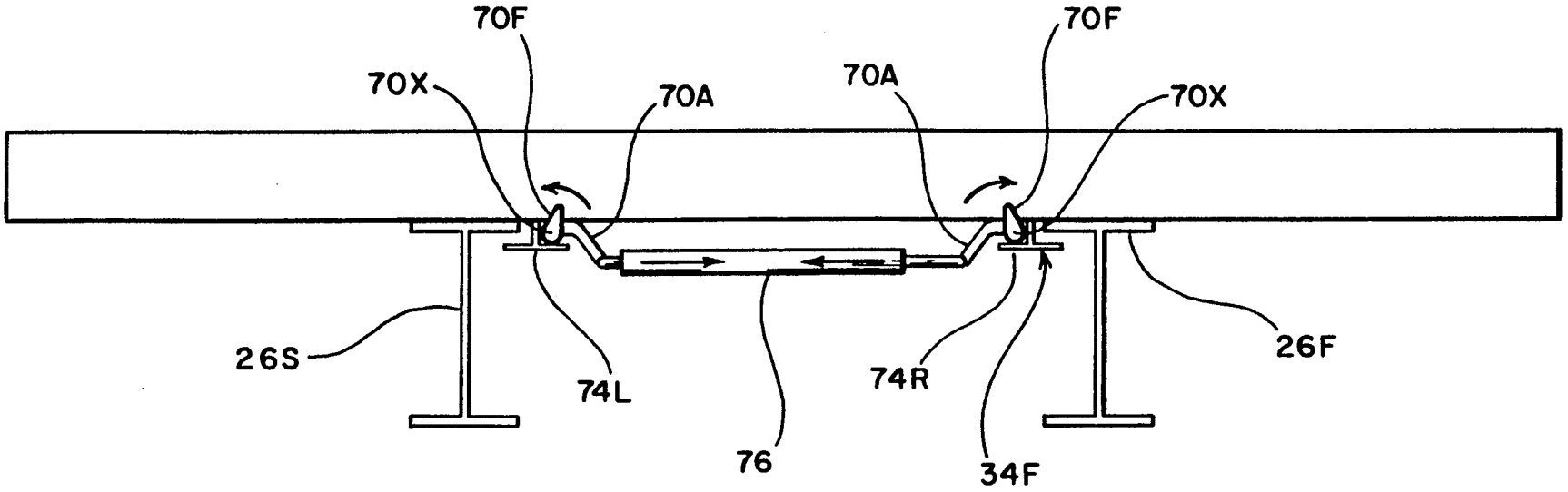
FIG. 14 is a simplified front view showing how conveyor lugs are used in the conveyor of the present invention.

With reference now to FIG. 12, there is shown the tie pickup 34F having a tie clamp 66 for lifting a tie 68F from resting on top of the rails to the position corresponding to tie 68S above the main frame 26. The tie 68S has been placed upon the conveyor 36C having first, second, third, and fourth cam - operated catches 70F, 70S, 70T, and 70F disposed thereon. Hydraulic cylinder 72 is used to move the conveyor 36C with the tie 68S on it. Considering FIG. 12 in conjunction with FIG. 13, the cylinder 72 may retract the conveyor 36C to the position of FIG. 13. The cam - operated catches 70F, 70S, 70T, and 70R, each of which is one of a pair are then retracted. As shown in FIG. 14, the conveyor 36C includes right and left movable members 74R and 74L, which members may slide along supports (not shown) which project out from the beams 26F and 26S of the main frame. A hydraulic cylinder 76 is pivotably mounted to arms 70A extending out from the opposite side cam catches 70F such that extension of the cylinder 76 causes the cams 70F to rotate about the axes 70X until the cams 70F are disposed below the top of the members 70L and 70R. In other words, the cams 70F would be retracted or lowered. At that stage, the cylinder 72 (FIGS. 12 and 13) could be extended to extend conveyor 36C without shifting tie 68S in the rightward direction of FIG. 13. Before the conveyor 36C is moved rightward from the retracted position of FIG. 13, the next tie 68F would be raised. The conveyor 36C would then be extended. Tie clamp 66 would then release that tie and, having raised the cam catches 70F, 70S, 70T, and 70R, the conveyor 36C may then be retracted to move tie 68F to the position corresponding to 68S in FIG. 13. Tie 68S will have been moved further leftward by operation of the conveyor 36C. In this manner, the ties are moved backward until they gather as a group 78 outside the forward range of the conveyor 36C. The ties gather as a group under the cab 28 and the engine 30 as best shown in FIG. 2. Although not shown, a conveyor similar to conveyor 36C may be used to move ties from under the cab 28 to the tie holding station or zone 38 of FIG. 2. A similar conveyor, also not shown, could be used to move the ties from the zone 38 to under the engine 30 still referring to FIG. 2. Thus, the present invention may include four conveyors such as conveyor 36C.

Figure 15:
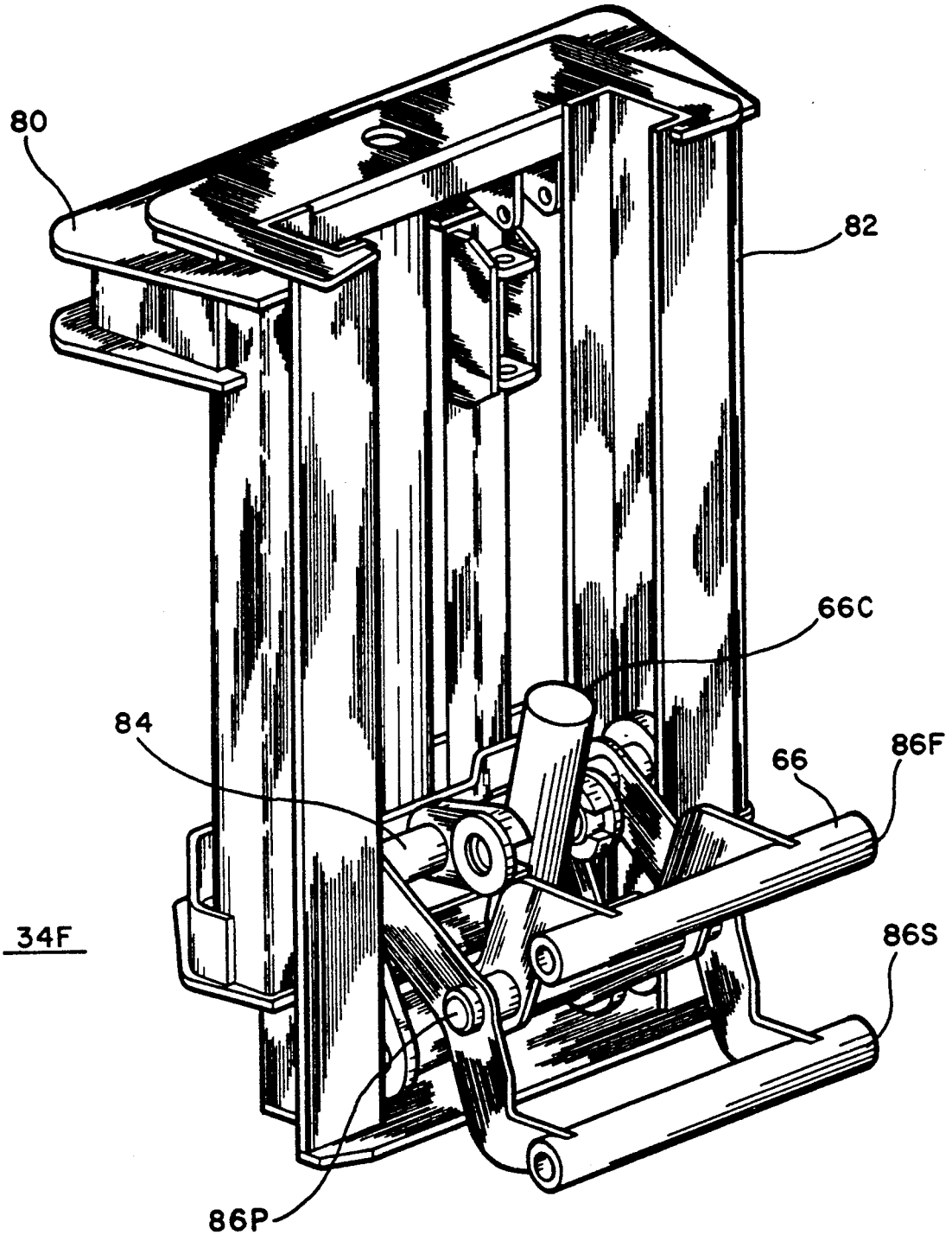
FIGS. 15 and 16 are perspective views of the tie pickup in different positions.
Figure 16:
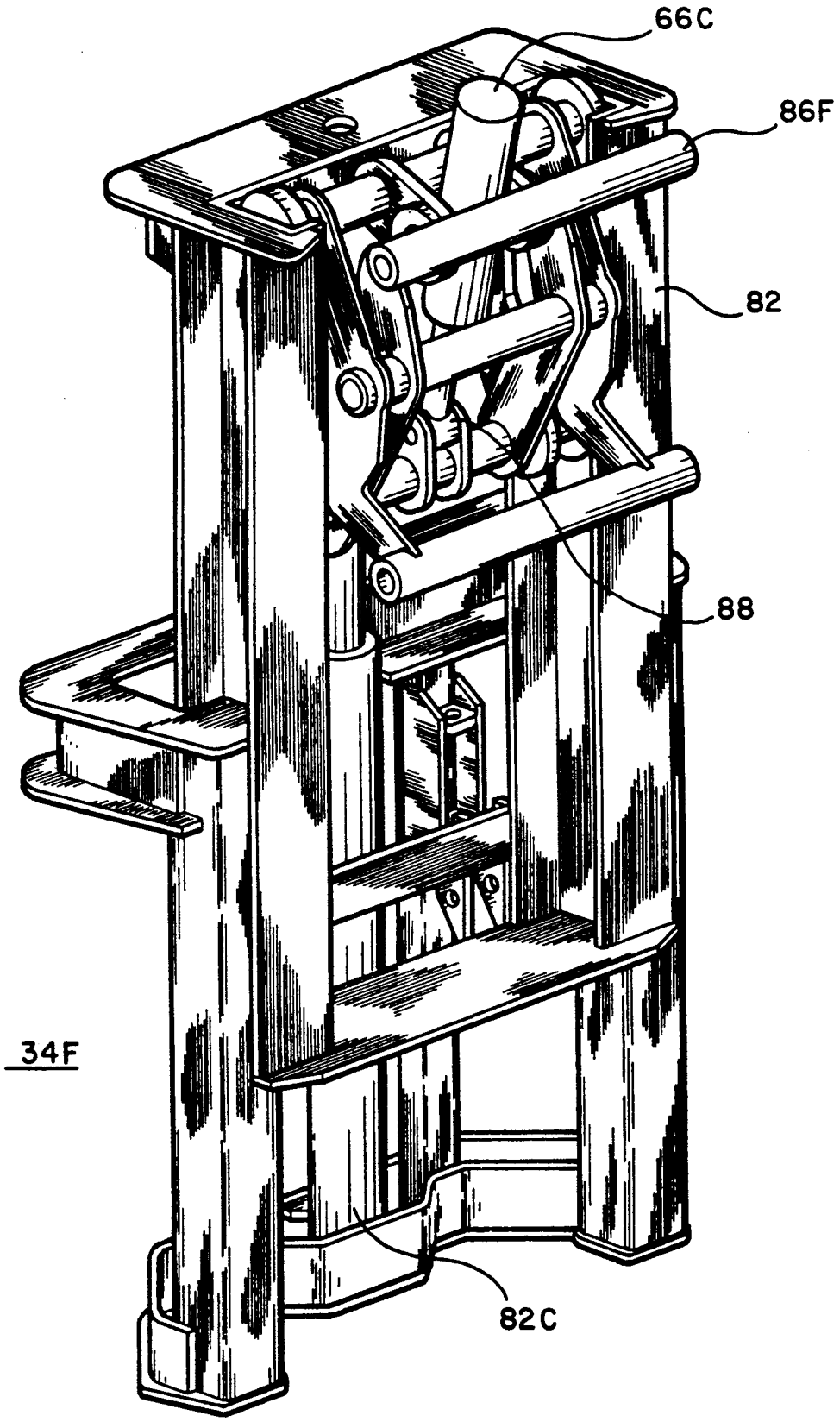

The operation of the tie pickup may be further explained with reference to FIGS. 15 and 16. The tie pickup 34F includes a stationary outer mast 80 and a movable inner mast 82. The outer mast 80 is fixed to the main frame (main frame not shown in FIGS. 15 and 16)

and the inner mast 82 moves from a lower position in FIG. 15 to a raised position in FIG. 16 by operation of a hydraulic cylinder 82C allowing ties held by tie clamp 66 to be raised and lowered. For moving them in both directions between the main frame and positioning on top of the rails, the tie clamp 66 moves between a closed position shown in FIG. 15 and an open position shown in FIG. 16 by operation of a hydraulic cylinder 66C. The hydraulic cylinder 66C is secured to a member 84 which rolls in a track within the inner mast 82. The tie clamp 66 has two opposing members 86F and 86S pivotably connected at point 86P. The member 86S is connected to the axle 84, whereas member 86F is rotatably connected to the piston corresponding to hydraulic cylinder 66C at 88 (see FIG. 16). When the hydraulic cylinder 66C is activated to move the tie clamp 66 from its closed position in FIG. 15 to its open position shown by FIG. 16, the members 86F and 86S will be moved back towards the stationary mast 80 and away from any tie which they have been gripping. In other words, they will be moved clear of any tie such that the tie gripper 66 may be moved up or down without hitting any tie which has just been deposited either on the conveyor 34F or on the rails.

Figure 17:
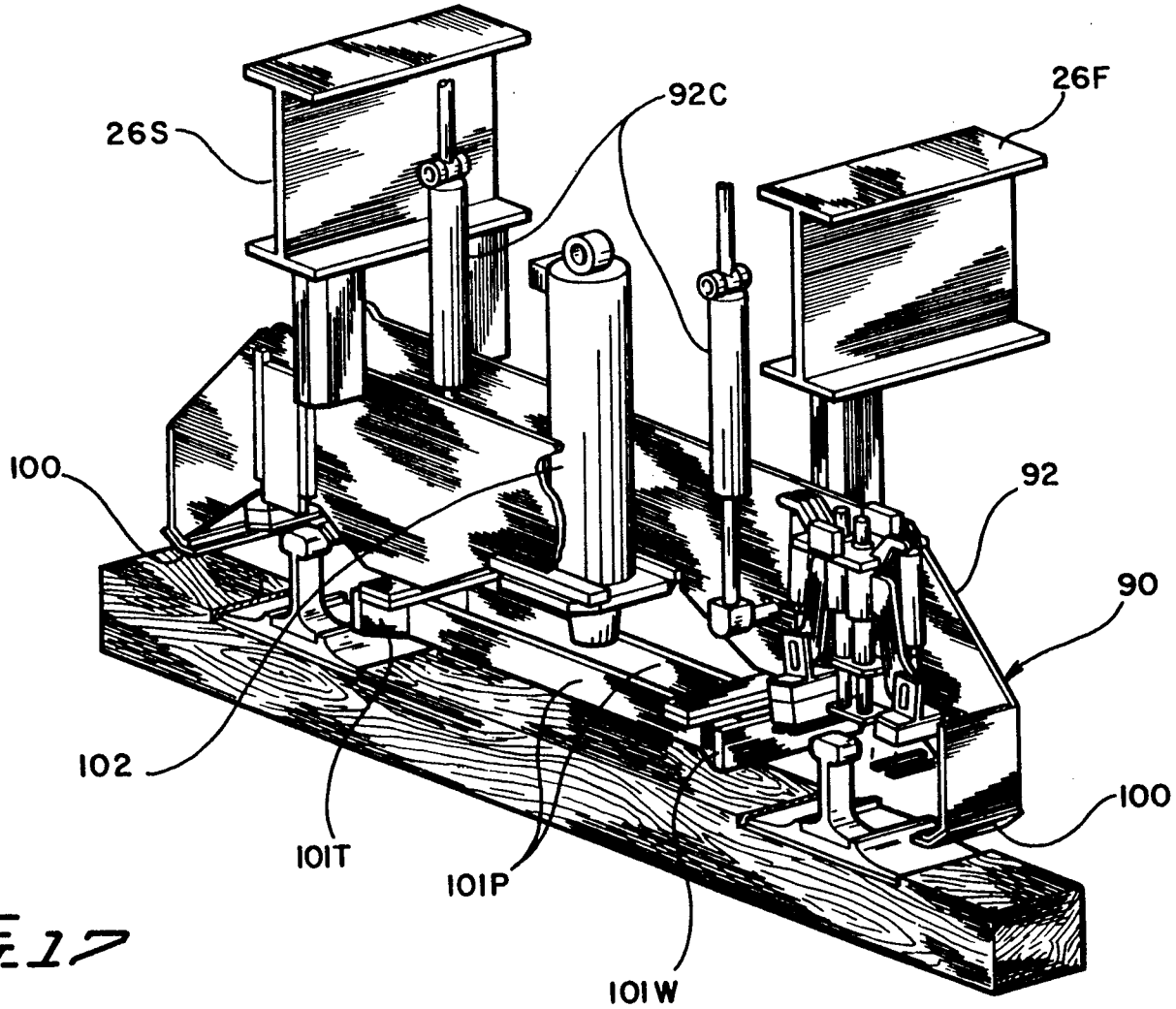
FIG. 17 is a perspective view of a tie guide and associated parts of the present invention.
Figure 18:
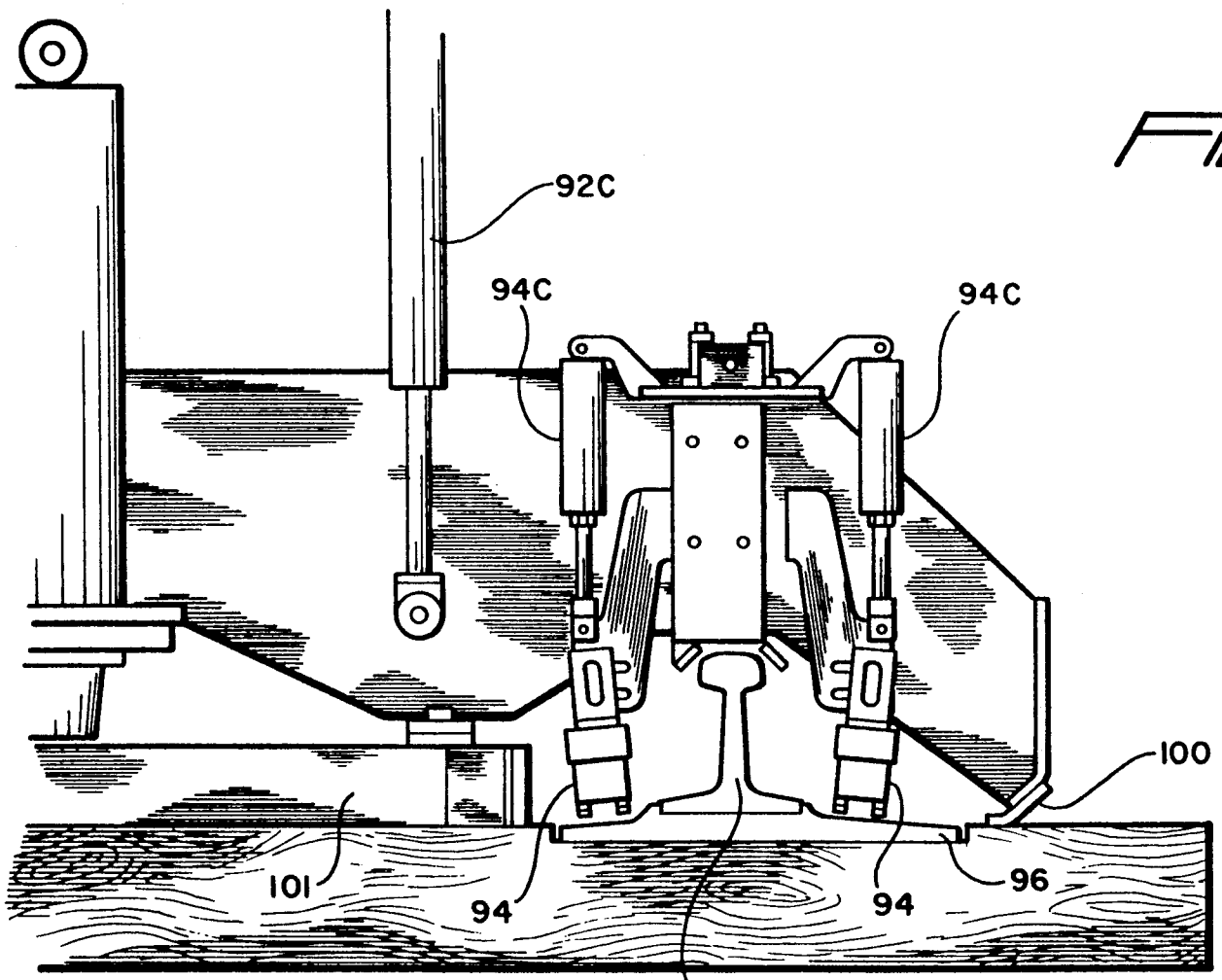
FIG. 18 is a front view of the tie guide and associated parts.

Turning now to FIGS. 17 and 18, a tie guide assembly 90 will be discussed. Various structures disclosed in detail in the incorporated by reference parent application might be used for holding the tie plates and guiding the tie, but the assembly 90 is preferred. The tie guide frame 92 extends across and above the front and back of the tie, but the front part is broken away in FIGS. 17 and 18 to allow one to view within the box-like frame 92. A tie guide frame 92 may be raised and lowered relative to the main frame by use of cylinders 92C. Mounted on the tie guide frame 92 are magnets 94 which may be lowered to contact the tie plate 96 by operation of air cylinders 94C. When one wants to extract an old tie, the tie guide frame 92 would be lowered by cylinders 92C, after which the magnets 94 would be brought in contact with the plates. The air pressure within cylinders 94C is then reversed causing the tie plate to be held against the bottom of rail 98. As the rail 98 is then lifted, the tie plates 94 may be lifted with it. The lifting of the rail 98 is accomplished by the rail clamps 40F and 40S and cylinders 40C (shown in FIG. 2 only). As the rail 98 is raised, the retraction of cylinders 94C and the operation of magnets 94 will keep the tie plate 96 held against the rail 98 and will recess the tie plates 96 within the tie guide frame 92. The old tie may then be removed using the procedure described in detail above. The new tie would then be inserted using the procedure also described above. Note that the tie guide frame is shaped including members such as 100 and member 101 having two parts 101P extending between the rails and being tapered out at parts 101T at each end to define a wide portion 101W. When the tie guide frame 92 is lowered the rails 98 and tie plates 96 are recessed within frame 92, such that these parts prevent a new tie from catching on tie plates or rails when the tie is being inserted. Further, parts 100 and 101 help keep ballast from staying on top of the new tie, thereby avoiding interference with placement of the tie plate 96 back upon any such new tie. After the new tie has been inserted, the tie plate 96 is placed on the new tie and the cylinders 92C are then operated to raise the tie guide frame 92.

FIG. 17 also shows a turntable cylinder 102 which may be used for turning the vehicle around upon a railroad track.

Although various structures and details have been included in the present description, it is to be understood that these are for illustrative purposes only. Various modifications and adaptations will be apparent to those of skill in the art. Accordingly, the scope of the present invention should be determined by reference to the claims appended hereto.

What is claimed is:

1. A tie replacement vehicle comprising:

(a) a main frame having a pair of front wheels and a pair of rear wheels;

(b) a lifting means having a portion disposed at a rail level corresponding to a pair of rails upon which said wheels are supported, said lifting means, mounted at a first end of said main frame, provided for lifting ties from said pair of rails to above said main frame;

(c) a lowering means having a portion disposed at said rail level, said lowering means, mounted at a second end of said vehicle opposite said first end, provided for lowering ties from above said main frame to on top of the pair of rails;

(d) movement means to selectively move ties over said main frame from said lifting means to said lowering means; and (e) a tie inserter supported by said main frame and including a first tie clamp for clamping ties, said tie inserter arranged to receive a tie previously placed above said main frame by said lifting means and to insert the tie under the pair of rails while the tie is clamped by said first tie clamp, and wherein said tie inserter includes an extendable boom extendable in a boom direction transverse to a lengthwise direction of said vehicle and a rotatable tie inserter head having said tie clamp mounted to said boom, said rotatable tie inserter head rotatable relative to said boom about a substantially horizontal axis, and said tie inserter is arranged to insert ties under the pair of rails by retraction of said boom.

2. The tie replacement vehicle of claim 1, wherein said tie inserter is arranged to remove old ties from a road bed.

3. The tie replacement vehicle of claim 1, wherein said substantially horizontal axis extends parallel to the lengthwise direction of the vehicle.

4. A tie replacement vehicle comprising:

(a) a main frame having a pair of front wheels and a pair of rear wheels;

(b) a lifting means having a portion disposed at rail level corresponding to a pair of rails upon which said wheels are supported, said lifting means, mounted at a first end of said main frame, provided for lifting ties from said pair of rails to above said main frame;

(c) a lowering means having a portion disposed at said rail level, said lowering means, mounted at a second end of said vehicle opposite said first end, provided for lowering ties from above said main frame to on top of the pair of rails;

(d) movement means to selectively move ties over said main frame from said lifting means to said lowering means;

(e) a tie inserter supported by said main frame and including a first tie clamp for clamping ties, said tie inserter arranged to receive a tie previously placed above said main frame by said lifting means and to insert the tie under the pair of rails while the tie is clamped by said first tie clamp; and (f) a tie feeding arm mounted to said main frame and having a feed gripper, and said tie inserter receiving a tie from above said main frame by way of said tie feeding arm.

5. The tie replacement vehicle of claim 4, wherein said tie feeding arm only moves a tie perpendicular to a lengthwise direction of said vehicle and within a vertical new tie movement plane.

6. The tie replacement vehicle of claim 4 wherein said tie feed arm includes a first member mounted to said main frame, a second member pivotably mounted to said first member and having said feed gripper mounted to said second member, and a swing means to pivot said second member relative to said first member.

7. The tie replacement vehicle of claim 6 wherein said second member extends at least partly in a lengthwise direction of said vehicle.

8. The tie replacement vehicle of claim 7 wherein said tie inserter includes an extendable boom extendable in a boom direction transverse to a lengthwise direction of said vehicle and a rotatable tie inserter head having said tie clamp mounted thereon, said rotatable tie inserter head rotatable about a substantially horizontal axis relative to said boom, and said rotatable tie inserter is arranged to insert ties under the pair of rails by retraction of said boom.

9. The tie replacement vehicle of claim 8, wherein said tie clamp is arranged to clamp ties disposed parallel to and offset from said boom direction.

10. The tie replacement vehicle of claim 8, wherein said tie feeding arm only moves a tie perpendicular to a lengthwise direction of said vehicle and within a vertical new tie movement plane, and said tie clamp is arranged to clamp ties when disposed in said vertical new tie movement plane.

11. The tie replacement vehicle of claim 4 wherein said tie feeding arm turns a tie upside down as it moves the tie from above said main frame to said tie inserter.

12. The tie replacement vehicle of claim 11 wherein said tie inserter includes an extendable boom extendable in a boom direction transverse to a lengthwise direction of said vehicle and a rotatable tie inserter head having said tie clamp mounted thereon, and wherein said boom is disposed below said main frame.

13. The tie replacement vehicle of claim 12, wherein said boom is pivotally mounted to said main frame by a pivot means having a horizontal axis extending perpendicular to said boom direction.

14. The tie replacement vehicle of claim 11, wherein said tie clamp is movably mounted to said boom by a mounting means for allowing shifting a tie transversely to said boom direction.

15. The tie replacement vehicle of claim 4 wherein said first tie clamp clamps a tie while it is gripped by said feed gripper.

16. A tie replacement vehicle comprising:

a main frame having a pair of front wheels and a pair of rear wheels;

a tie holding station on the vehicle for holding new ties for insertion;

a tie handling means including a tie feeding arm means for directly gripping a new tie in said holding station and lowering said new tie from said holding station, and a tie inserter means for receiving said new tie directly from said tie feeding arm means and inserting said new tie under a pair of rails;

said tie feeding arm means including means for allowing said tie feeding arm means to pivot about a horizontal pivot axis extending in a lengthwise direction of said vehicle; and said tie inserter means including an arm means and a tie clamping means mounted at one end of said arm means, said clamping means receiving said new tire directly from said tie feeding arm means and inserting said new tire under said pair of rails.

17. The tie replacement vehicle of claim 16, wherein said tie feeding arm means only moves a tie perpendicularly to a lengthwise direction of said vehicle and within a vertical new tie movement plane.

18. The tie replacement vehicle of claim 16, wherein said tie feeding arm means includes a first member mounted to said main frame, a second member pivotally mounted to said first member, a feed gripper mounted to said second member, and a swing means to pivot said second member relative to said first member, and wherein said second member extends at least partly in a lengthwise direction of said vehicle.

19. The tie replacement vehicle of claim 16 wherein said arm means includes a boom extendable in a boom direction transverse to a lengthwise direction of said vehicle.

20. The tie replacement vehicle of claim 19 wherein said boom is disposed below said main frame.

21. The tie replacement vehicle of claim 16 further comprising a tie pickup mounted at an end of said main frame and having a pickup clamp, said tie pickup operable to move ties from resting on the rails to above said main frame, and further comprising movement means to selectively move ties over said main frame.

22. The tie replacement vehicle of claim 21 further comprising an operator cab mounted to said main frame by way of supports and wherein said movement means moves ties horizontally below said operator cab and above said main frame.

23. The tie replacement vehicle of claim 21 wherein said tie pickup is operable to move ties by moving said pickup clamp along a vertical member.

24. The tie replacement vehicle of claim 16 further comprising a tie guide mounted to said main frame via a tie guide cylinder, said tie guide cylinder arranged for lowering said tie guide relative to said main frame into a position for preventing said new tie, during being inserted under the pair of rails, from catching on a rail and a tie plate.

* * * * *

UNITED STATES PATENT AND TRADEMARK OFFICE

CERTIFICATE OF CORRECTION

PATENT NO. : 5,197,389

DATED : March 30, 1993

INVENTOR(S) : Krzysztof E. GLOMSKI; G. Robert NEWMAN; Harry MADISON

It is certified that error appears in the above-identified patent and that said Letters Patent is hereby corrected as shown below:

Column 14, line 18, change "tire" to -- tie --;

Column 14, line 20, change "tire" to -- tie --.

Signed and Sealed this

Twenty-third Day of November, 1993

*Attest:*

*Attesting Officer*

Bruce Lehman

BRUCE LEHMAN

*Commissioner of Patents and Trademarks*